US009168579B2

(12) United States Patent
Buettner et al.

(10) Patent No.: US 9,168,579 B2
(45) Date of Patent: Oct. 27, 2015

(54) PUNCHING TOOLS AND RELATED MACHINES AND METHODS

(75) Inventors: Stefan Buettner, Markgroeningen (DE); Wolfgang Laib, Besigheim (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 188 days.

(21) Appl. No.: 13/240,296

(22) Filed: Sep. 22, 2011

(65) Prior Publication Data

US 2012/0042764 A1 Feb. 23, 2012

Related U.S. Application Data

(63) Continuation of application No. PCT/DE2010/000316, filed on Mar. 23, 2010.

(30) Foreign Application Priority Data

Mar. 25, 2009 (DE) ..... 20 2009 004 014 U

(51) Int. Cl.

| | |
|---|---|
| ***B21D 28/34*** | (2006.01) |
| ***B21D 28/00*** | (2006.01) |
| ***B21D 28/02*** | (2006.01) |
| ***B21D 28/04*** | (2006.01) |
| ***B21D 37/00*** | (2006.01) |

(Continued)

(52) U.S. Cl.

CPC ..... *B21D 28/34* (2013.01); *B21D 28/00* (2013.01); *B21D 28/02* (2013.01); *B21D 28/04* (2013.01); *B21D 37/00* (2013.01); *B21D 37/04* (2013.01); *B21D 37/14* (2013.01); *Y10T 29/49826* (2015.01); *Y10T 83/9476* (2015.04)

(58) Field of Classification Search

CPC ..... B21D 28/04; B21D 28/02; B21D 28/00; B21D 37/14; B21D 37/00; B21D 37/04; B21D 28/36; B21D 28/346; B21D 28/343; B21D 28/34; Y10T 83/9476

USPC ..... 83/684–691

See application file for complete search history.

(56) References Cited

U.S. PATENT DOCUMENTS

| | | | | |
|---|---|---|---|---|
| 1,984,839 | A * | 12/1934 | Murray | 116/200 |
| 2,287,882 | A * | 6/1942 | Huff | 279/83 |
| 2,592,978 | A * | 4/1952 | Trimboli | 81/177.1 |

(Continued)

FOREIGN PATENT DOCUMENTS

| | | | |
|---|---|---|---|
| CN | 2843687 | Y | 12/2006 |
| CN | 101108448 | A | 1/2008 |

(Continued)

OTHER PUBLICATIONS

Notification of Transmittal of Translation of the International Preliminary Report on Patentability from corresponding PCT Application No. PCT/DE2010/00316, mailed Oct. 6, 2011, 8 pages.

*Primary Examiner* — Sean Michalski
*Assistant Examiner* — Jonathan G Riley
(74) *Attorney, Agent, or Firm* — Fish & Richardson P.C.

(57) ABSTRACT

In some aspects of the invention, a punching tool includes a punching stamp including a stamp shaft and an axial stop; and an adjustment ring having a center opening configured to receive the stamp shaft and abut the axial stop, where a first mark is located along a cylindrical portion of the stamp shaft adjoining the axial stop, and at least a portion of the first mark remains visible when the adjustment ring is abutted against the axial stop.

19 Claims, 4 Drawing Sheets

(51) Int. Cl.
*B21D 37/04* (2006.01)
*B21D 37/14* (2006.01)

(56) References Cited

U.S. PATENT DOCUMENTS

| | | | | | |
|---|---|---|---|---|---|
| 3,641,860 | A * | 2/1972 | Whistler et al. | 83/686 |
| 4,710,075 | A * | 12/1987 | Davison | 408/202 |
| 5,890,897 | A * | 4/1999 | Kruger et al. | 433/75 |
| 6,514,258 | B1 * | 2/2003 | Brown et al. | 606/80 |
| 7,048,477 | B2 * | 5/2006 | Abrams | 408/1 R |
| 7,771,143 | B2 * | 8/2010 | Bharadwaj et al. | 408/1 R |
| D662,802 | S * | 7/2012 | DeBaker | D8/86 |
| 8,418,587 | B2 * | 4/2013 | DeBaker | 81/436 |
| 2003/0005802 | A1 * | 1/2003 | Kyono et al. | 83/531 |
| 2004/0048675 | A1 * | 3/2004 | Kamenov | 464/107 |
| 2004/0149149 | A1 * | 8/2004 | Schneider | 101/3.1 |
| 2006/0169117 | A1 * | 8/2006 | Schneider | 83/684 |
| 2007/0156164 | A1 * | 7/2007 | Cole et al. | 606/187 |
| 2010/0275741 | A1 * | 11/2010 | Lai | 81/438 |
| 2012/0067189 | A1 * | 3/2012 | Kraft et al. | 83/698.91 |

FOREIGN PATENT DOCUMENTS

| | | | |
|---|---|---|---|
| DE | 3736062 | A1 | 5/1989 |
| DE | 10032045 | A1 | 1/2002 |
| DE | 20219369 | U1 | 3/2003 |
| DE | 20315143 | U1 | 12/2003 |
| DE | 10255219 | B3 | 3/2004 |
| DE | 202006000788 | * | 5/2006 |
| DE | 202006000788 | U1 * | 5/2006 |
| DE | 102006002547 | A1 | 6/2007 |
| DE | 102006020446 | A1 | 11/2007 |
| EP | 1213065 | B1 * | 9/2006 |

* cited by examiner

PUNCHING TOOLS AND RELATED MACHINES AND METHODS

CROSS REFERENCE TO RELATED APPLICATIONS

This application is a continuation of, and claims priority under 35 U.S.C. §120 to, PCT Application No. PCT/DE2010/000316, filed on Mar. 23, 2010, which claimed priority to German Application No. 20 2009 004 014, filed on Mar. 25, 2009. The contents of both of these priority applications are hereby incorporated by reference in their entirety.

TECHNICAL FIELD

The present invention relates to punching tools and related machines and methods.

BACKGROUND

The main components of a punching tool typically include a punching stamp and an adjustment ring. The adjustment ring is typically used to retain the punching tool in a tool retention member of a machine tool (e.g., a punching machine). A punching tool can refer not only to a tool used for conventional punching processes, but also to tools that are suitable for other workpiece processing operations (e.g., shaping, embossing, molding, and other operations).

There are various types of punching stamps that are adapted for use in various different material processing operations. Accordingly, there are also various types of adjustment rings that are adapted to different stamp shaft configurations of punching stamps and are intended to adapt the punching tools to various machine retention members of machine tools. However, due to the various types and configurations of adjustment rings and punching stamps that are available, incompatible combinations of adjustment rings and punching stamps can be inadvertently assembled.

Generally, two types of stamps with different stamp shaft configurations are used. One type of stamp includes an axial stop that is constructed as a planar face. Another type of stamp includes an axial stop that is constructed in a stepped manner and has at least one step. For the stamp shaft configuration having a planar face axial stop, an adjustment ring with a corresponding planar lower side is typically suitable. For the stamp shaft configuration having a stepped axial stop, an adjustment ring with a corresponding stepped lower side is typically suitable. The total thicknesses of the adjustment rings used with each type of axial stop are generally the same. If an adjustment ring with a planar lower side is used with a stamp having a stepped axial stop to produce the punching tool, the adjustment ring typically sits too high on the stamp shaft. As a result, the punching tool typically does not properly fit into a stamp receiving member of a machine retention member on a machine tool, and, therefore, the machine tool is not operational.

Due to the incorrect assembly, when replacing a punching tool using a tool changing device on a machine tool, a collision may occur if the machine tool does not have a stamp height monitoring system. Although, in machine tools having a stamp height monitoring system, an error message typically occurs in the event of incorrect stamp height, the stamp height is first checked using the machine tool, which leads to, at the very least, a disruption of production and potentially a program abortion with a subsequent restart. In a worst case, the incorrect height can lead to the separation of the workpiece that has just been processed, which results in a reject. The punching tool is typically also removed from the machine tool so that the adjustment ring can be replaced and aligned.

DE 100 32 045 C2 discloses a punching tool including a punching stamp that can be secured in an adjustment ring, a wedge that is provided to prevent rotation in a tool retention member, and a rotation prevention member between the stamping punch and the adjustment ring. The rotation prevention member is secured to the wedge in a positive-locking manner at the side of the adjustment ring in the direction of rotation.

DE 10 2006 002 547 A1 discloses a punching tool (e.g., for punching machines) having tool changing devices in which the punching stamp and the adjustment ring are arranged in a defined angular position relative to each other. The punching stamp and the adjustment ring each have corresponding receiving members, in which an adjustment element is inserted or engages. The punching stamp and the adjustment ring can be connected or are connected by a locking seat.

SUMMARY

In some aspects of the invention, a punching tool includes a mark applied to a stamp shaft that is spaced at a distance from the axial stop which corresponds to at least an axial thickness of an adjustment ring to be used with the stamp shaft. The spacing of the mark from the axial stop ensures that the mark remains visible after a correct adjustment ring has been positioned against the axial stop.

The mark is applied to the stamp shaft in order to identify if an adjustment ring that is compatible with the punching stamp has been placed on the stamp shaft. The mark is typically located away from the axial stop by a distance that approximately corresponds to the axial thickness of an adjustment ring that is compatible with the punching stamp. When a non-compatible adjustment ring is placed on a punching stamp, the mark is typically covered by the adjustment ring. When the mark cannot be seen, the incorrect combination of an adjustment ring and a punching stamp can be identified. Although the mark is spaced away from the axial stop by a distance that corresponds to the axial thickness of the associated compatible adjustment ring, at least a portion of the mark should be spaced further apart from the axial stop so that it remains at least partially visible after the compatible adjustment ring has been fitted.

The mark can be applied during fabrication of the stamp by any of various types of machining processes (e.g., by laser inscription). If the mark is formed as part of the same laser machining process that forms the upper portion of the punching stamp, there can be little to no additional costs involved with forming the mark. Since the mark is typically formed as a notch having a very small depth, there is typically also little technical risk (e.g., risk of breaking) associated with forming the mark (e.g., as compared to stress concentrations that could be generated due to deeper notches). The mark may also be applied to the punching stamp using production methods other than laser inscription. Examples of other suitable production methods include knurling or engraving using a lathe. The methods described herein including using identifying marks applied to punching stamps to verify proper tooling combinations can be used with punching tools having adjustment rings and stamps other than the types described herein. Other types of adjustment rings and stamps can also be retrofitted to include such marks. Using punching stamps having such marks, it is also possible to omit measurement verification or estimation of the stamp height from the punching tools assembly process.

The spacing of the mark from the axial stop is typically no more than about 3 mm (e.g., no more than about 1 mm) greater than the thickness of the adjustment ring. By keeping the spacing within this range, it can be ensured that the stamp height is selected not to be too large, since the mark remains visible only if the thickness of the adjustment ring deviates only slightly from the nominal thickness of the adjustment ring. It can also be identified whether a compatible adjustment ring has been completely fitted on the punching stamp.

The correct combination of punching stamp and adjustment ring can consequently be ensured during assembly by simple visual inspection to determine if the mark is visible. In addition, it is ensured that the adjustment ring is in contact with the axial stop, which is also advantageous since a correctly selected but improperly installed adjustment ring can also lead to certain problems described above.

In some embodiments, the mark is formed by a continuous ring on the stamp shaft. Due to the continuous mark, it can be ensured that the mark remains visible from all sides. In addition, the mark is limited in an axial direction to the width of the adjustment ring and is typically 2 mm or less (e.g., about 1 mm) so that even slight deviations from the predetermined axial thickness of the adjustment ring can be identified.

In some embodiments, the axial stop includes a step formed circumferentially around the axial stop. When the axial stop includes a step, the correct combination of the punching stamp and adjustment ring is important because if an incorrect adjustment ring (e.g., an adjustment ring with a planar lower side) is fitted to the punching stamp, the punching stamp may not be able to be properly secured in the tool stamp receiving member or may collide with the tool stamp receiving member.

In another aspect of the invention, a mark is applied to the punching stamp and also to the associated adjustment ring. The marks typically have at least one common feature. Punching stamps and adjustment rings that are associated with each other can be identified using marks that correspond to each other. The corresponding feature of the marks is typically the shape of the mark and/or the color of the mark. Corresponding adjustment rings and punching stamps can consequently be identified by corresponding geometry or corresponding color of the mark. Using these types of marks, visual identification is typically carried out by an operator. Alternatively, automated identification using optical sensors is also possible. The marks can be constructed in such a manner that they indicate a radial position on the punching stamp and the adjustment ring so that they can be brought into a correct angular position in which the two components can subsequently be fixed (e.g., by an adjustment element), as discussed below. Such marks or portions of the marks, in certain embodiments, extend only over a small angular range. For example, the marks or portions can extend over a range that is less than 5° (e.g., less than 1°). In some cases, a tip can be formed on the marks for this purpose.

In some embodiments, the punching stamp and the adjustment ring have corresponding receiving members for an adjustment element in order to arrange the punching stamp and the adjustment ring in a defined angular position relative to each other. The adjustment element can be, for example, a centering pin which is inserted in two aligned axial holes in the punching stamp or the adjustment ring. If the mark on the stamp shaft is complemented by a pin connection between the stamp and adjustment ring, the punching stamp can typically be pre-assembled without additional alignment concerns. The mark on the stamp shaft helps to ensure the correct selection and the correct height of the adjustment ring and the pin connection helps to ensure the exact angular position of the punching stamp (e.g., with respect to an adjustment wedge).

In another aspect of the invention, a machine tool for the punching and/or shaping processing operation of a plate-like workpiece (e.g., a metal sheet) includes at least one punching tool, as described herein. The operationally reliable assembly of the correct adjustment ring positioned on a punching stamp allows effective control of the stamp height of the punching tool so that operational malfunctions due to an incorrect stamp height can be prevented.

In another aspect of the invention, a method of verifying the proper combination of an adjustment ring with a punching stamp includes placing the adjustment ring on the stamp shaft until the adjustment ring abuts an axial stop of the punching stamp (e.g., a stepped axial stop) and verifying whether a mark on the punching stamp or stamp shaft that is at a position spaced from the axial stop by a distance that corresponds at least to the axial thickness of an adjustment ring associated with the punching stamp remains visible after the adjustment ring abuts the axial stop.

The details of one or more embodiments of the invention are set forth in the accompanying drawings and the description below. Other aspects, features, and advantages of the invention will be apparent from the description and drawings, and from the claims.

DETAILED DESCRIPTION

Figure 1:
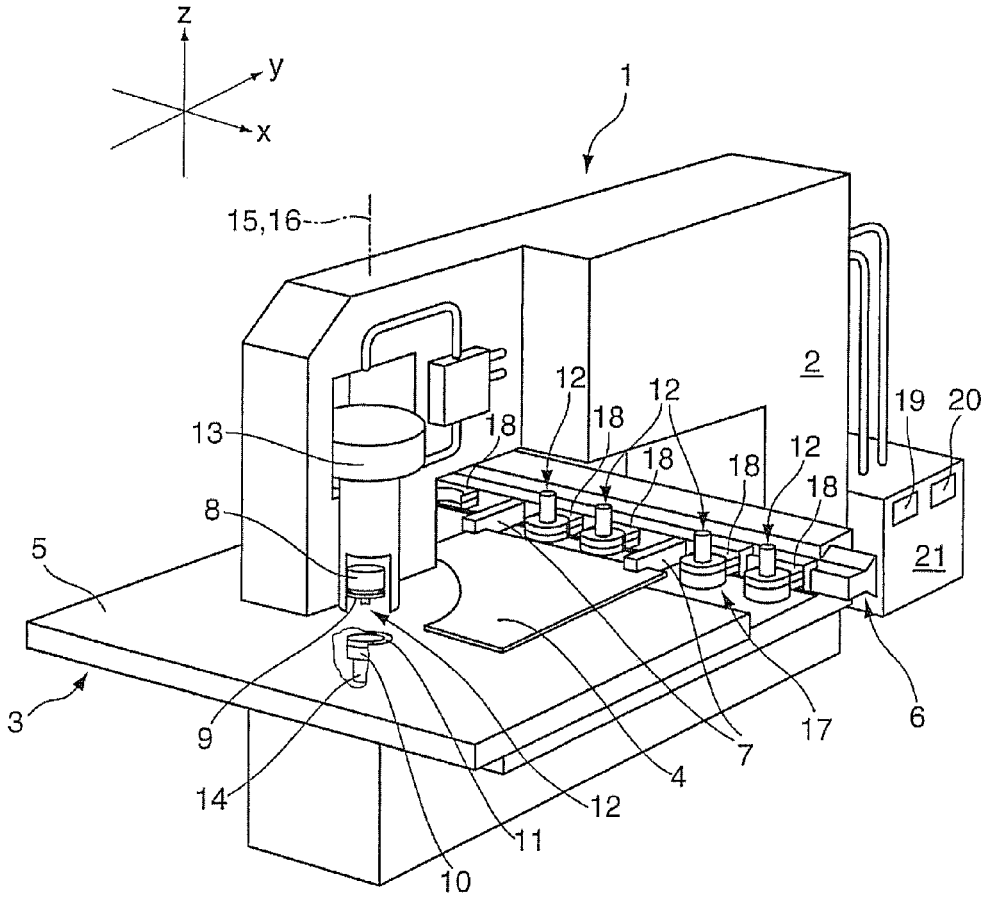
FIG. 1 is a schematic illustration of a machine tool for processing plate-like workpieces.

FIG. 1 illustrates a machine tool 1 for punching and/or shaping plate-like workpieces, such as metal sheets. The punching/shaping machine 1 has a C-shaped machine frame 2 that includes a workpiece support in the form of a workpiece table 3 that serves to support a workpiece (e.g., a metal sheet) 4. At the upper side of the workpiece table 3, a horizontal support plane 5 is formed that extends along an x-direction and a y-direction and supports the metal sheet 4 to be processed. Using a coordinate guide 6, the metal sheet 4, which is clamped to the coordinate guide 6 by collet chucks 7, can be moved along the support plane 5 of the workpiece table 3.

At the front end of the upper member of the C-shaped machine frame 2, a tool stamp receiving member 8 is arranged in which a punching tool 9 having a punching stamp is supported. Additionally, a tool die receiving member 10 in which a tool die 11 is supported is provided at the front end of the lower member of the C-shaped machine frame 2. The punching tool 9 and the tool die 11 together form a tool unit 12 for a separating and/or shaping processing operation of the metal sheet 4.

A drive unit of the punching/shaping machine 1 is formed by a stamp drive 13 and a die drive 14 that are powered by linear drives. Using the stamp drive 13, the tool stamp receiving member 8 together with the punching tool 9 that is supported thereon or secured thereto can be raised and lowered along a travel axis 15 with respect to the workpiece table 3. In a comparable manner, the tool die receiving member 10 together with the tool die 11 which is supported or secured therein can be raised and lowered along the travel axis 15 with respect to the workpiece table 3 by the die drive 14. The tool stamp receiving member 8 and the tool die receiving member 10 can further be rotationally adjusted about a tool rotation axis 16, which is identical to the travel axis 15, by a rotary drive.

A linear magazine 17 with additional tool units 12 is provided on the coordinate guide 6. The tool units 12 located along the linear magazine 17 are each retained by a tool cartridge 18 and, depending on requirements, can be secured to the tool stamp receiving member 8 or the tool die receiving member 10 in order to process the metal sheet 4.

When a tool is changed and when the workpiece is processed, the drives (e.g., the stamp drive 13 and the die drive 14) of the punching/shaping machine 1 are controlled by a numerical control unit 21. The numerical control unit 21 includes a storage device 19 for storing tool data and an additional control device 20 in order to measure and control the lifting, lowering and rotational movements of both the tool stamp receiving member 8 and the tool die receiving member 10 based on the stored data relating to the workpiece 4 and the tool 12, respectively.

Figure 2A:
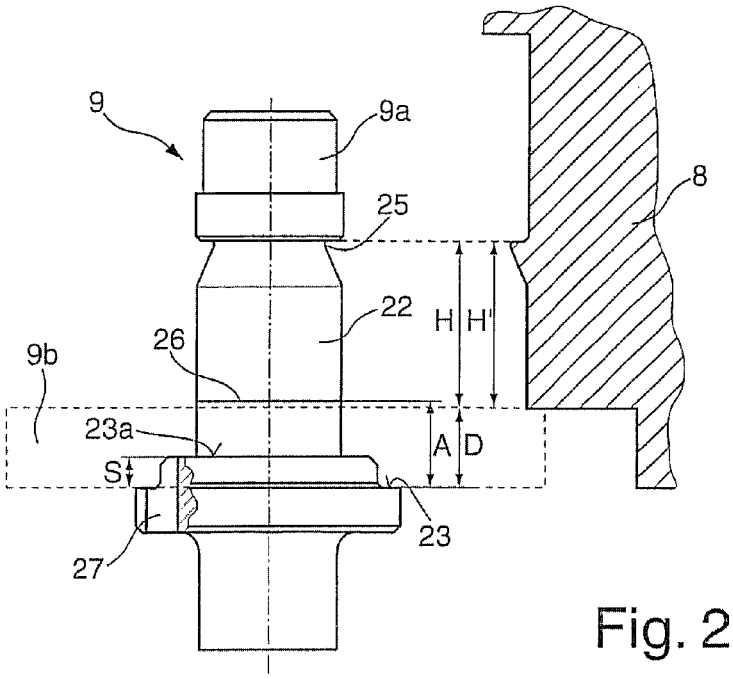
FIGS. 2*a-c* and 2*d* are schematic illustrations, respectively, of a punching tool that includes a properly assembled adjustment ring and an improperly assembled adjustment ring, along with a punching stamp having a mark on its stamp shaft.
Figure 2B:
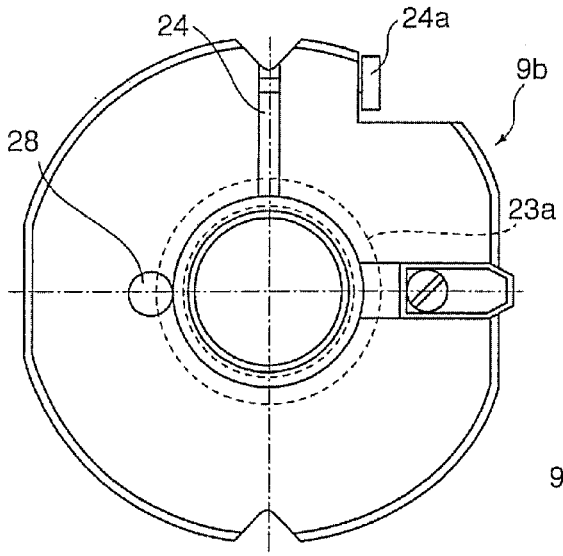
Figure 2C:
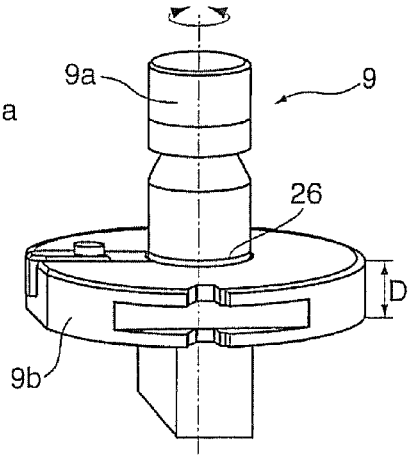

FIGS. 2*a-c* illustrate a construction of the punching tool 9 of FIG. 1. As shown in FIG. 2*a*, the punching tool 9 includes a punching stamp 9*a* and an adjustment ring 9*b*. The adjustment ring 9*b* is placed on a stamp shaft 22 of the punching stamp 9*a* against an axial stop or shoulder 23 that is formed on the stamp shaft 22 and includes a radially inner step 23*a*. After being placed against the axial stop 23, the adjustment ring 9*b* can be secured to the stamp shaft 22, for example, by being fixed or clamped using a fixing screw 24*a*, as shown in FIG. 2*b*, that extends through a gap 24 in the adjustment ring 9*b*. A wedge on the adjustment ring 9*b* serves to prevent rotation of the punching tool 9 in a tool retention member.

The adjustment ring 9*b* has a thickness D so that when the step 23*a* of the adjustment ring 9*b* abuts the stepped stop 23 of the punching stamp 9*a*, a stamp shaft height H is formed between the upper side of the adjustment ring 9*b* and a radially continuous groove 25 of the stamp shaft 22. The stamp shaft height H corresponds to a height H' that is formed on the tool stamp receiving member 8 between a projection and a shoulder that the adjustment ring 9*b* abuts when the punching tool 9 is secured to the tool stamp receiving member 8. In some embodiments, the thickness D of the adjustment ring 9*b* is 10 mm. When the punching stamp 9*a* and adjustment ring 9*b* are assembled to each other, it is ensured that the stamp shaft 22 of the punching stamp 9*a* can be inserted in the tool stamp receiving member 8 since the head of the punching stamp 9*a* typically does not collide with the projection on the tool stamp receiving member 8. In the event of an incorrect combination of a punching stamp 9*a* and adjustment ring 9*b*, however, the stamp shaft height H between the adjustment ring 9*b* and the groove 25 in the stamp shaft 22 may differ from the height H' at the tool stamp receiving member 8 and lead to a collision.

Figure 2D:
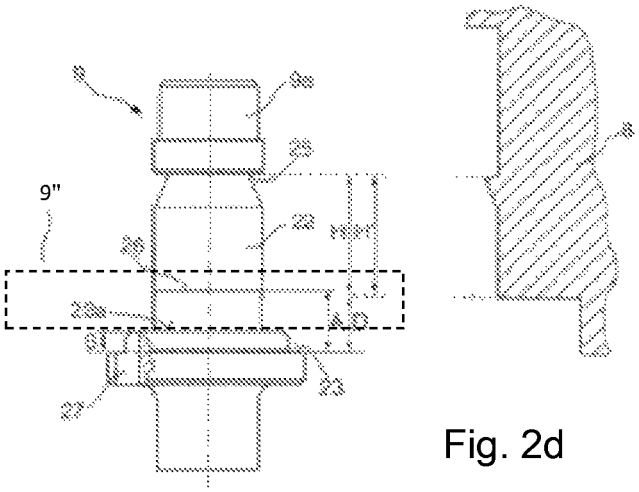

In order to identify an incorrect assembly of a punching tool 9 having an incorrect adjustment ring 9*b* placed on the punching stamp 9*a*, a mark 26 in the form of a continuous ring is applied to a cylindrical portion of the stamp shaft 22 of the punching stamp 9*a*. The mark 26 is spaced apart from the axial stop 23 by a spacing A that is slightly greater than the axial thickness D of the adjustment ring 9*b*. In some embodiments, the spacing A is no more than 5% (e.g., 2%) greater than the axial thickness D of the adjustment ring 9*b*. In some embodiments, the spacing A is no more than 1 mm greater than the axial thickness D of the adjustment ring 9*b*. As shown in FIG. 2*d*, the size of spacing A is dependent on the height of the step 23*a* at the axial stop 23 because the spacing A is typically selected to be so large that the mark 26 is covered by an incorrect adjustment ring, such as an adjustment ring 9*b*" whose lower side is not formed complementary to the stepped stop 23 (e.g., an adjustment ring with a planar lower side). As a result of this, the spacing A will typically not exceed the sum of the thickness D of the adjustment ring 9*b* and the step height S of the step 23*a*, as shown in FIG. 2*a*.

The mark 26 can be applied to the stamp shaft 22 by various fabrication techniques. In some embodiments, the mark 26 is applied by laser inscription. Although the mark 26 is shown as being constructed as a continuous straight line, alternatively, the mark 26 can be constructed to have other appearances (e.g., a broken line, a zigzag line, or other lines). However, the axial thickness of the mark typically does not exceed about 1 mm, in order to ensure proper recognition of the correct adjustment ring 9*b* installed to the punching stamp 9*a* with the stepped stop 23.

The mark is constructed in such a manner that it remains at least partially visible after the adjustment ring 9*b* has been positioned, and thus helps to ensure identification of the correct combination of a stamping punch 9*a* and adjustment ring 9*b*. It can also be identified whether a compatible adjustment ring 9*b* is completely pushed onto the punching stamp 9*a*.

The punching stamp 9*a* and the adjustment ring 9*b* include axial holes 27, 28 that are positioned so that the punching stamp 9*a* and adjustment ring 9*b* can be properly aligned once assembled. Using a centering pin, which engages in the aligned holes 27, 28, the punching stamp 9*a* and adjustment ring 9*b* can be fixed in the correct angular position.

Using the techniques described above, the punching tool 9 can be preassembled without additional alignment devices or techniques since the mark 26 can ensure the correct selection and the correct height of the adjustment ring 9*b* and the pin connection can ensure proper angular alignment of the punching stamp 9*a* with respect to the adjustment ring 9*b*.

Figure 3A:
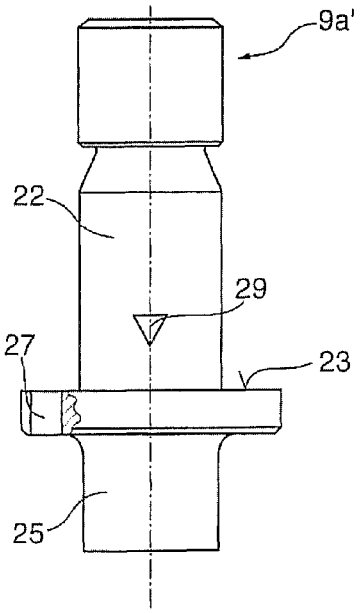
FIGS. 3*a-c* are schematic illustrations of a punching tool that includes a punching stamp having a mark on its stamp shaft and an adjustment ring having a mark thereon.
Figure 3B:
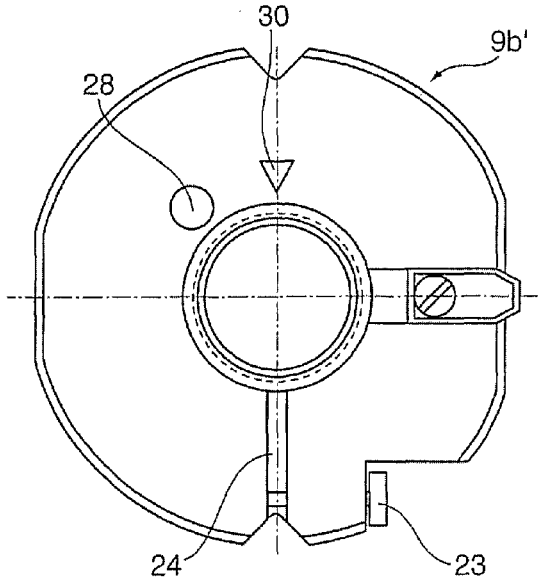
Figure 3C:
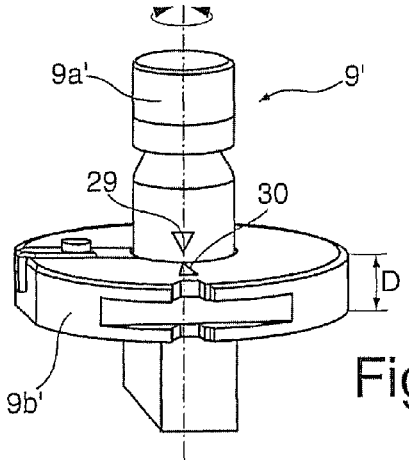

The correct combination of a punching stamp and adjustment ring can also be established using another configuration of a punching tool 9', as shown in FIGS. 3*a-c*. As shown in FIGS. 3*a-c*, both the punching stamp 9*a*' and the adjustment ring 9*b*', which has a thickness D, have marks 29, 30 in the form of a triangle. Due to the corresponding shape of the marks 29, 30, the association or compatibility of the adjustment ring 9*b*' with the punching stamp 9*a*' can be identified. Additionally or alternatively, there can also be a correspondence between the marks 29, 30 in terms of color or other features (e.g. shapes other than triangles) that allow associated pairs of punching stamps and adjustment rings, which can be assembled to form a punching tool, to be identified.

In the configuration of the punching stamp 9*a*' shown in FIG. 3*a*, which has a planar axial stop face 23, the problem of deviation of the stamp shaft height H from the height H' predetermined by the tool stamp receiving member 8 typically does not arise. Deviation of the stamp shaft height H from the height H' typically does not arise because both the adjustment ring 9*b*' (shown in FIG. 3*b*) that has a planar lower side, and the adjustment ring 9*b* (shown in FIG. 2*a*) that has a recess along the lower side, could potentially be placed on the punching stamp 9*a*' of FIG. 3*a*, and the maximum stamp height would typically not be exceeded since the upper sides of the adjustment rings 9*b*, 9*b*' have the same spacing D from the stop face 23 in both cases.

Due to the marks 29, 30, it is also possible to align the punching stamp 9*a*' and the adjustment ring 9*b*' in a defined angular position. For example, when the marks 29, 30 each have a tip, as shown in FIGS. 3*a-c*, the tips of the marks 29, 30 can be orientated in an aligned manner. It is also possible to use only the marks 29, 30 for fixing the correct angular position of the adjustment ring 9*b*' when the marks 29, 30 are aligned with each other, and not additionally utilize features of the receiving members for this purpose.

The preliminary set-up operation of a punching tool can be simplified in the manners described above by utilizing a visual verification/examination of the assembled punching tool. The use of such visual verification/examination of the assembled punching tool can help to prevent assembly errors, such as an incorrect combination of a punching stamp and an adjustment ring or an incorrect clamping position of the adjustment ring with respect to the punching stamp. The visual verification typically does not require the operator to have any knowledge of punching technology. Due to the operationally reliable assembly, interruptions to production (e.g., resulting from machine down-times, tooling collisions, or other interruptions) can be prevented when the punching tools described herein are used in a machine tool.

A number of embodiments of the invention have been described. Nevertheless, it will be understood that various modifications may be made without departing from the spirit and scope of the invention. Accordingly, other embodiments are within the scope of the following claims.

What is claimed is:

1. A punching tool comprising:

a punching stamp comprising:

a stamp shaft comprising a lower portion that is configured to contact a workpiece when the punching stamp is operated to process the workpiece and an upper cylindrical portion that is configured to be received in a tool receiving member, and an axial stop adjoining the stamp shaft and separating the lower portion from the upper cylindrical portion of the stamp shaft, the axial stop comprising a circumferential step and a circumferential extension projecting radially outward from the circumferential step;

a first adjustment ring defining a first center opening configured to receive the stamp shaft, the first center opening defining a radial recess that extends inwardly from a first lower surface of the first adjustment ring and that is formed complementary to and configured to abut the circumferential step of the axial stop, wherein a first mark is located along the upper cylindrical portion of the stamp shaft adjoining the axial stop, and at least a portion of the first mark remains visible when the first adjustment ring is abutted against the circumferential step and the circumferential extension projecting radially outward from the circumferential step, such that a proper assembly of the first adjustment ring with the stamp shaft can be verified; and a second adjustment ring defining a second center opening configured to receive the stamp shaft, the second adjustment ring comprising a second lower surface that is not formed complementary to the circumferential step of the axial stop, wherein a distance between the first mark and the circumferential extension of the axial stop is less than or equal to a sum of a thickness of the second adjustment ring and a height of the circumferential step of the axial stop, such that the first mark is covered by the second adjustment ring when the second adjustment ring is abutted against the circumferential step of the axial stop.

2. The punching tool according to claim 1, wherein the first mark is spaced from the circumferential extension of the axial stop by a distance that corresponds to an axial thickness of the first adjustment ring.

3. The punching tool according to claim 2, wherein the distance between the first mark and the circumferential extension of the axial stop is no more than 3 mm greater than the axial thickness of the first adjustment ring.

4. The punching tool according to claim 3, wherein the distance between the first mark and the circumferential extension of the axial stop is no more than 1 mm greater than the axial thickness of the first adjustment ring.

5. The punching tool according to claim 1, wherein the first mark comprises a continuous ring that encircles the stamp shaft.

6. The punching tool according to claim 1, wherein the first mark is inscribed in the stamp shaft.

7. The punching tool according to claim 1, wherein the first mark is applied as coloring to the stamp shaft.

8. The punching tool according to claim 1, further comprising a second mark formed along the first adjustment ring.

9. The punching tool according to claim 8, wherein the first mark and the second mark are the same color and/or the same shape.

10. The punching tool according to claim 1, wherein the punching stamp and the first adjustment ring each have corresponding receiving members configured to receive an adjustment element in order to secure the punching stamp and the first adjustment ring in an angular position relative to each other.

11. The punching tool according to claim 1, wherein the first adjustment ring comprises a gap that extends radially from the first center opening to an outer circumferential surface of the first adjustment ring, and a fixing screw that is configured to reduce a width of the gap in order to secure the first adjustment ring to the punching stamp.

12. The punching tool according to claim 1, wherein the second lower surface of the second adjustment ring comprises a planar surface.

13. The punching tool according to claim 1, wherein the circumferential step of the axial stop prevents the second lower surface of the second adjustment ring from contacting the circumferential extension of the axial stop when the second adjustment ring is abutted against the circumferential step of the axial stop.

14. A machine tool for processing plate-like workpieces, the machine tool comprising:

a punching tool comprising:

a punching stamp comprising:

a stamp shaft comprising a lower portion that is configured to contact a workpiece when the punching stamp is operated to process the workpiece and an upper cylindrical portion that is configured to be received in a tool receiving member, and an axial stop the stamp shaft and separating the lower portion from the upper cylindrical portion of the stamp shaft, the axial stop comprising a circumferential step and a circumferential extension projecting radially outward from the circumferential step;

a first adjustment ring defining a first center opening configured to receive the stamp shaft, the first center opening defining a radial recess that extends inwardly from a lower surface of the first adjustment ring and that is formed complementary to and configured to abut the circumferential step of the axial stop, wherein a first mark is located along the upper cylindrical portion of the stamp shaft adjoining the axial stop, and at least a portion of the first mark remains visible when the first adjustment ring is abutted against the circumferential step and the circumferential extension projecting radially outward from the circumferential step, such that a proper assembly of the first adjustment ring with the stamp shaft can be verified; and a second adjustment ring defining a second center opening configured to receive the stamp shaft, the second adjustment ring comprising a second lower surface that is not formed complementary to the circumferential step of the axial stop, wherein a distance between the first mark and the circumferential extension of the axial stop is less than or equal to a sum of a thickness of the second adjustment ring and a height of the circumferential step of the axial stop, such that the first mark is covered by the second adjustment ring when the second adjustment ring is abutted against the circumferential step of the axial stop.

15. The punching tool according to claim 14, wherein the first mark is spaced from the axial stop by a distance that corresponds to an axial thickness of the first adjustment ring.

16. The punching tool according to claim 15, wherein the distance between the first mark and the circumferential projection of the axial stop is no more than 3 mm greater than the axial thickness of the first adjustment ring.

17. The machine tool according to claim 14, further comprising a second mark formed along the first adjustment ring, wherein the first mark and the second mark are the same color and/or the same shape.

18. The machine tool according to claim 14, wherein the second lower surface of the second adjustment ring comprises a planar surface.

19. The machine tool according to claim 14, wherein the circumferential step of the axial stop prevents the second lower surface of the second adjustment ring from contacting the circumferential extension of the axial stop when the second adjustment ring is abutted against the circumferential step of the axial stop.

* * * * *